US005469803A

United States Patent [19]

Gallo

[11] Patent Number: 5,469,803

[45] Date of Patent: Nov. 28, 1995

[54] INDIVIDUAL UNDERWATER PROPULSION DEVICE

[75] Inventor: Jean-Pierre Gallo, Figeac, France

[73] Assignee: Fem-Aero, Figeac, France

[21] Appl. No.: 341,590

[22] PCT Filed: May 17, 1993

[86] PCT No.: PCT/FR93/00474

§ 371 Date: Nov. 21, 1994

§ 102(e) Date: Nov. 21, 1994

[87] PCT Pub. No.: WO93/23119

PCT Pub. Date: Nov. 25, 1993

[30] Foreign Application Priority Data

May 19, 1992 [FR] France ..... 92 06344

[51] Int. Cl.[6] ..... B63C 11/46

[52] U.S. Cl. ..... 114/315; 440/38

[58] Field of Search ..... 114/315, 242; 440/38; 441/55, 65

[56] References Cited

U.S. PATENT DOCUMENTS

| | | | |
|---|---|---|---|
| 2,722,021 | 11/1955 | Keogh-Dwyer | 114/315 |
| 3,503,356 | 3/1970 | Wilson | 114/315 |
| 3,721,208 | 3/1973 | Lampert et al. | 440/38 |

FOREIGN PATENT DOCUMENTS

| | | | |
|---|---|---|---|
| 701186 | 2/1966 | Italy | 114/242 |

*Primary Examiner*—Jesus D. Sotelo
*Attorney, Agent, or Firm*—Young & Thompson

[57] ABSTRACT

An underwater device using a reaction propulsion system. The initial flow entering by a front end turbine (1) is divided into two laminar, partially divergent flows (2) enabling the diver to place himself in the wake of the device. The power supply (3) is built into the device or is externally attached to the diving material, and an electrical cable (4) provides the electric power supply. The novel shape of the propulsion system makes it a handy and efficient device, especially suitable for underwater diving.

12 Claims, 4 Drawing Sheets

INDIVIDUAL UNDERWATER PROPULSION DEVICE

FIELD OF THE INVENTION

The present invention concerns an electric propulsion device intended for underwater diving.

BACKGROUND OF THE INVENTION

Conventional underwater propulsion systems are formed in the manner of torpedoes and the principal flow resulting from rotation of the propeller is ejected along the axis of symmetry of the device.

The diver must therefore be offset with respect to this axis, and the beam in the direction of the displacement becomes increased.

There thus results a rocking force, operator fatigue, and energy loss. On the other hand, the maneuverability is strongly affected by the relative position of the diver with respect to the propulsion device. High speeds cannot be attained by this type of device.

FIG. 1 shows such a conventional propulsion device, in which the diver must be shifted along the axis OZ so as to be displaced above the turbulence generated by the propeller.

One prior art solution consists of placing two turbomotors on both sides of the propulsion device, as shown in DE-A-35 23 758, but this solution is complex and costly.

SUMMARY OF THE INVENTION

The present invention allows the performance of the propulsion device to be improved, and its operational control to be facilitated. To this end, the propulsion device is constituted by a symbolic hyperform symmetrical with respect to the displacement plane OXY of the diver, shown in FIG. 2. This shape employs the equivalent of two hydrofoil plates profiled along the axis OX of displacement.

DETAILED DESCRIPTION OF THE INVENTION

Figure 1:
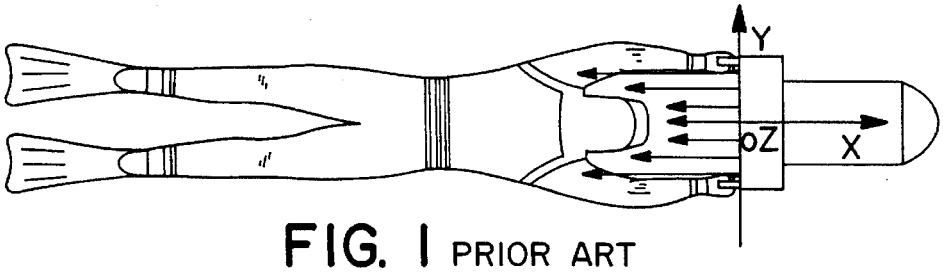
FIG. 1 PRIOR ART
FIG. 1 depicts a conventional propulsion device, in which the diver must be shifted along the axis OZ so as to be displaced above the turbulence generated by the propeller.
Figure 2:
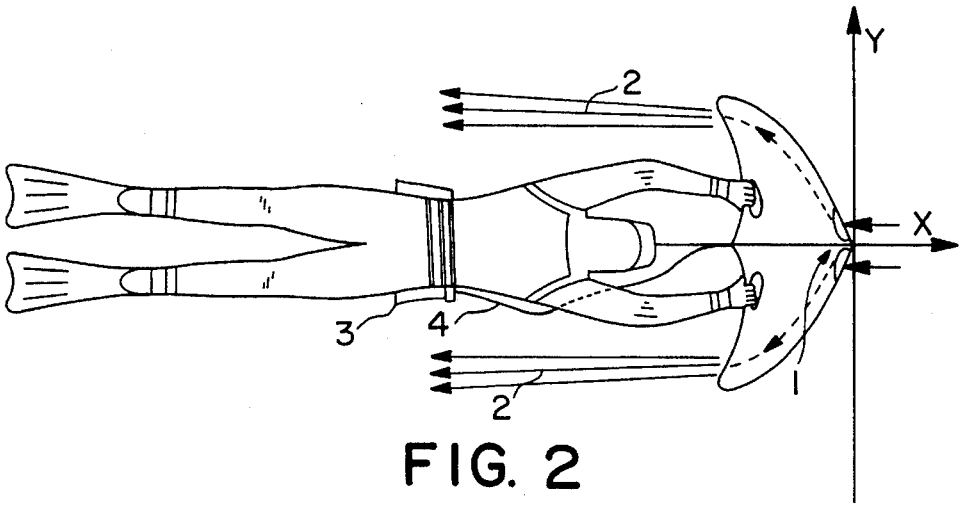
FIG. 2 depicts a diver using a propulsion device according to the invention.

FIG. 2 shows the basic principle of the propulsion device according to the invention. The diver holds the device at the ends of his arms along the axis of displacement, and the water is sucked in through a forwardly located opening 1. The inlet flow is then divided into two symmetrical transferences, and discharged on both sides of the diver. The two secondary flows 2 are partially divergent, to improve the hydrodynamics and the propulsion generated by reaction.

The shape and the stability of such a propulsion device according to the invention, permits the diver to control the rolling and rocking forces.

Zig-zag maneuvering is facilitated by the flattened shape of the body in the plane OXY. For improved directional control, an aileron 6 may be mounted as shown in FIG. 3, which shows in three views the overall shape of the device resulting from an initial purely aesthetic study to which successive functional features were applied according to the desired technical results.

Figure 3:
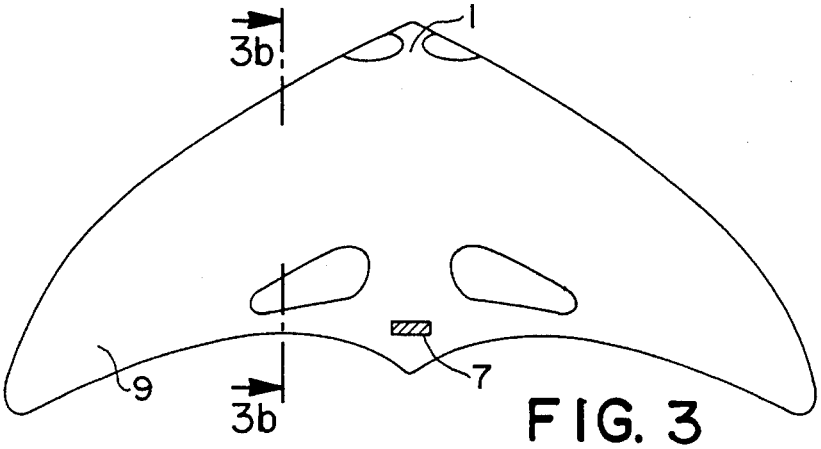
FIG. 3 is a plan view of one embodiment of the present invention.
Figure 3B:
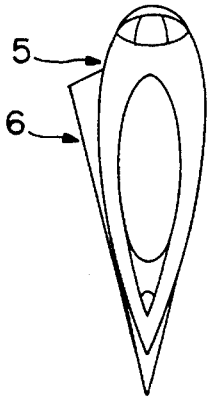
FIG. 3*b* is a view of FIG. 3 taken along line 3*b*—3*b* of FIG. 3.
Figure 3A:
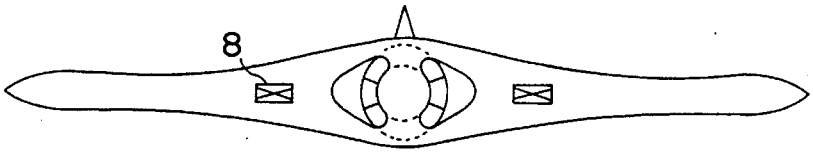
FIG. 3*a* is an elevational view of FIG. 3.
Figure 4:
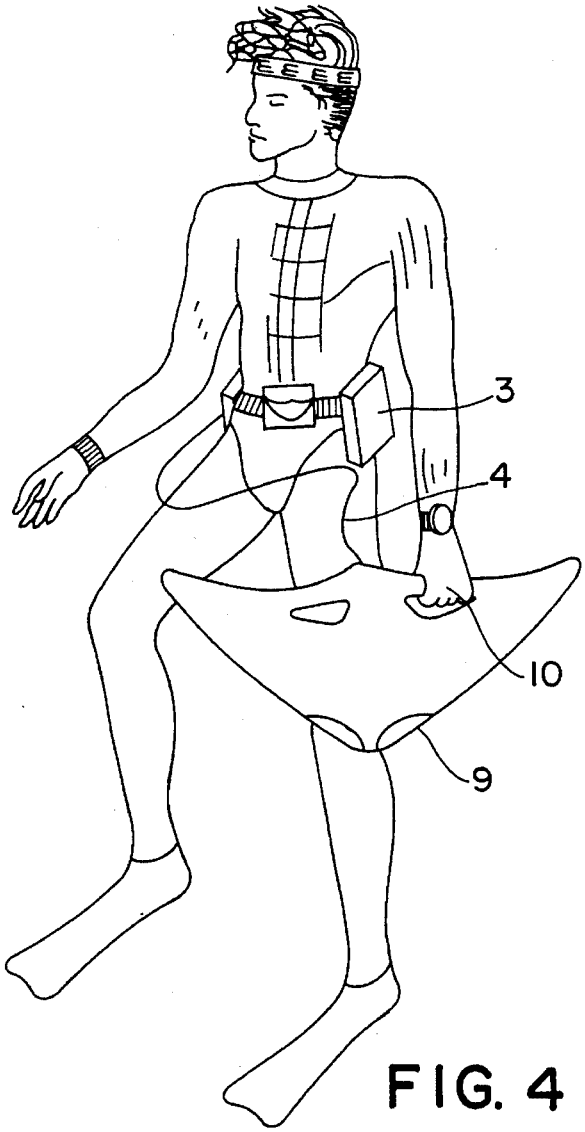
FIG. 4 shows a diver equipped with a propulsion device according to the present invention.

Thus, the wing profile chosen for the body is neutral, as shown at detail 5 in FIG. 3, since when diving the weight is compensated by the hydrostatic pressure and no dynamic lift should occur during travel.

Two headlights 8 and a speed control 7 may be built into the device.

Moreover, the remotely positioned batteries permit replacing weights normally used to neutralize the buoyancy of the diver.

For an additional weight advantage relative to a conventional propulsion device, a cable 4 allows electric power to be supplied to the motor built into the device.

In the case where a more self-contained construction is required, the weight corresponding to the batteries may be compensated by volumes of foam having a density less than one, and this compensation may also be effected by using an inflatable dive vest.

Polymeric batteries having a density substantially equal to two may also be used, and require little hydrostatic compensation.

Figure 5:
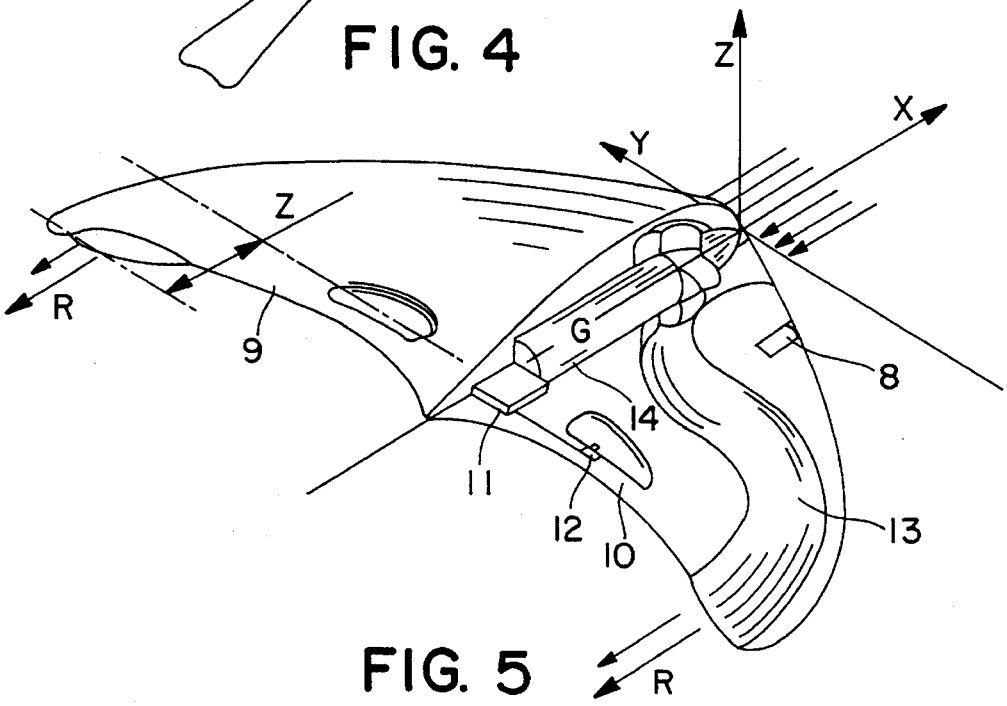
FIG. 5 is a perspective view partially cut away of the propulsion device of the invention.

FIG. 5 shows the equilibrium of such a propulsion device made according to the invention. The body 9, formed from a material whose density is less than one, produces an upwardly directed hydrostatic buoyancy G. The total weight of the propulsion device, comprising the body and the interior components such as motor 14 and directional control system 11, must correspond to G so that the propulsion device is in equilibrium regardless of its position.

The handles 10 formed integrally with the body and the reaction forces R should be substantially aligned within a zone Z having the smallest possible extent along the direction OX.

This exploded view of a propulsion device according to the invention also shows the body 9 formed from two symmetrical half-shells. The manufacture, assembly and maintenance are thus considerably simplified, and the investment in molds is reduced.

The assembly of these two half-shells along the plane OXY permits obtaining the exterior shape having its qualities of hydrodynamics and esthetics. On the other hand, interior cavities are also formed by this assembly, which give rise to the basic principle of the invention concerning separation into two symmetrical flows by two transferences.

Thus, the interior shapes are harmonized with the exterior shapes, to reduce as much as possible the submerged volume.

Figure 6:
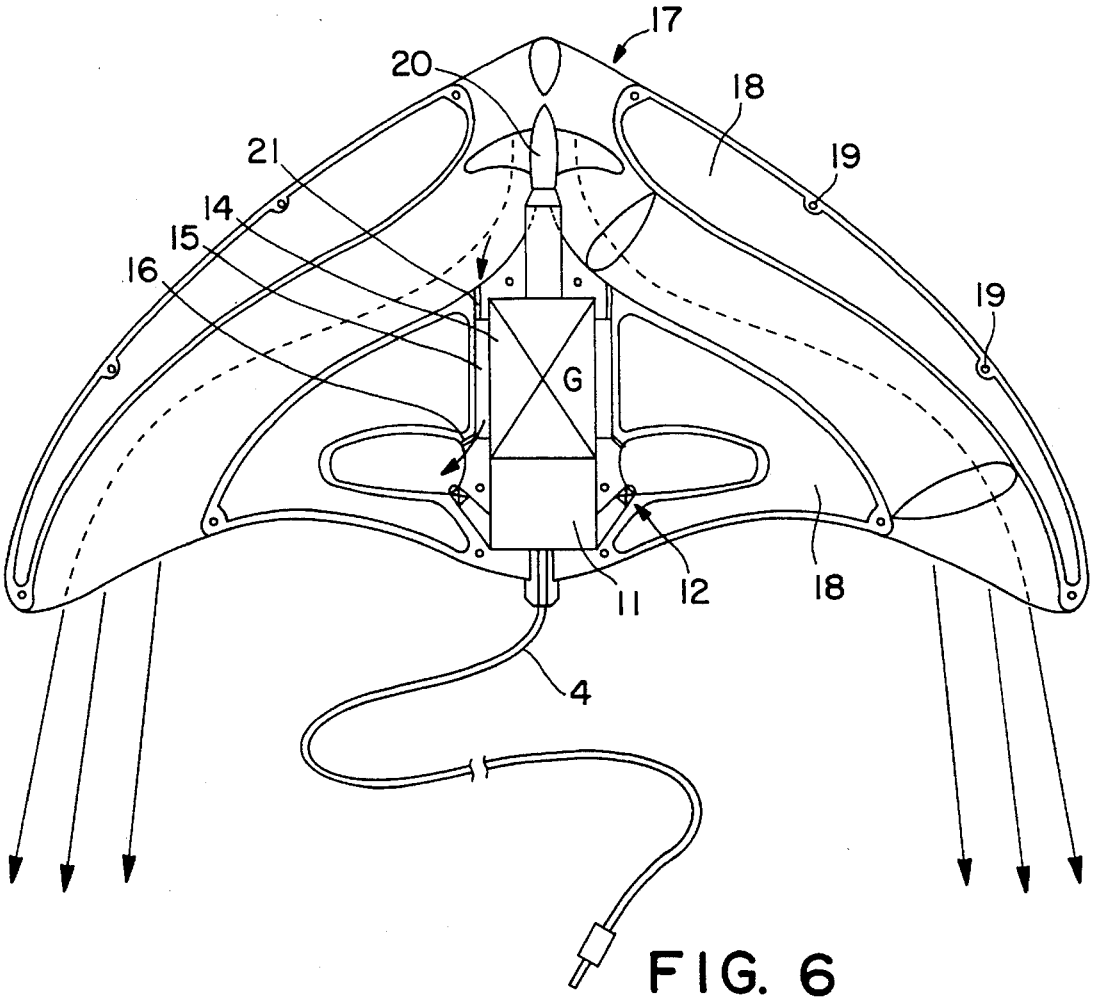
FIG. 6 is a plan view of the propulsion device of the present invention with the top removed to show the inside thereof.

The motor 14 shown in FIG. 6 is positioned so as to correspond with the center of hydrostatic buoyancy G, as it is the heaviest component and any offset would require counterbalancing by additional weights.

A chamber 15 is provided surrounding the motor so as to cool it, with water circulation being allowed by a calibrated conduit 21 whose inlet is situated downstream of the turbine and whose outlet 16 is rearwardly thereof.

This conduit is calibrated according to the power chosen for the motor, and the corresponding amount of heat to be dissipated.

The housing for the electronic control is provided rearwardly of the motor, with FIG. 6 showing such a control element 11 comprising two arms provided with sealed switches 12 ending at the handles.

This control module is obtained by molding components on an electronic circuit board and is placed in a housing directly molded on the body.

The electronic circuit comprises a power cutoff, a load controller and a safety system in case the propeller becomes jammed. A simplified version comprises only a control relay.

The motor shaft comprises at its end a propeller 20 that sucks in water and drives it into the transferences.

Figure 7:
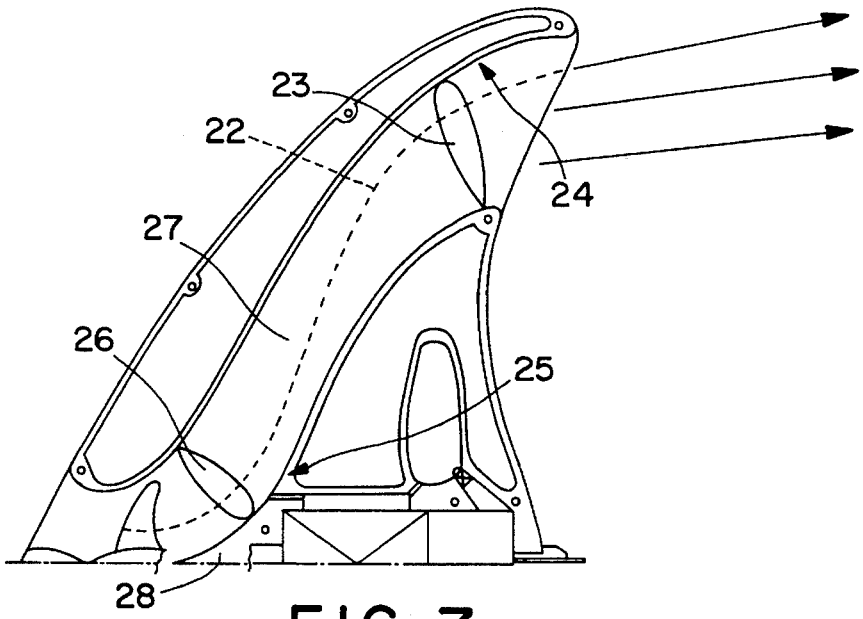
FIG. 7 is a view of the right wing of FIG. 6 showing the dynamic aspect of the water flow.

The initial flow generated by the high efficiency propeller is divided in an optimum manner. The dynamic aspect of the flow is described in FIG. 7. First, the separating edge 28 effects an initial division along the geometric axis of symmetry 27 of the transference. A primary impulsion zone 25 resulting from an asymmetric profile 26 of the conduit allows priming a dynamic axis 22 toward the secondary impulsion zone 24.

The shape of the conduit results from the progressive passage from 26 to 23 along the geometric axis of symmetry, and there thus results a flow along the dynamic axis with a minimum of turbulence and a better hydrodynamic reaction.

Figure 8B:
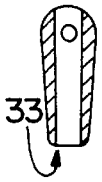
FIG. 8*b* is an enlarged cross section of the nozzle 33 taken along line 8*b*—8*b* of FIG. 8.
Figure 8:
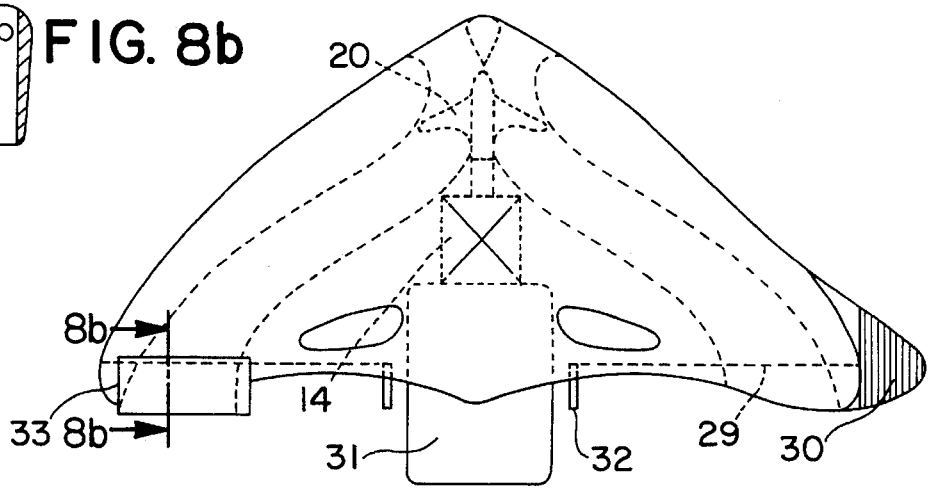
FIG. 8 is a plan view of another embodiment of the present invention.
Figure 8A:
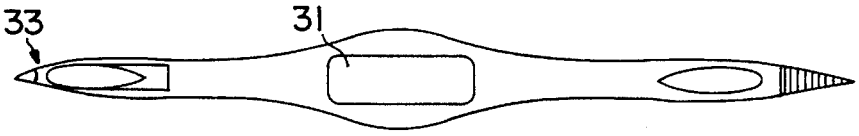
FIG. 8*a* is an elevational view of FIG. 8.

Control flaps 30 may be installed at the wing tips, as shown in FIG. 8. They permit controlling the rolling and rocking forces by actuating two levers 32 situated near to the handles and connected to the flaps by two shafts 29 perpendicular to the direction of the displacement.

According to another embodiment, shaft 29 drives a nozzle 33.

This same figure shows the possibility of mounting a battery pack 31 to the rear of the apparatus, which is configured for this purpose. The corresponding housing consists of a parallelepipedal cavity comprising two separated contacts for supplying current.

According to another embodiment, polymeric batteries are disposed on the junction plane with a thickness on the order of 10 mm. They should be adapted to the interior profile of the body of the propulsion device.

According to a preferred manufacturing technique, the two pieces of the body are formed by reaction/injection molding with a material whose density is less than 1, and the completed unit is made using screws 19 disposed perpendicular to the plane OXY, as shown in FIG. 6.

According to another manufacturing technique, the two pieces of the body are formed by injection molding a material having a density greater than 1. In this case, cavities 18 are provided as shown in FIG. 6, and in which blocks of foam are disposed so as to obtain a relative density less than 1, thereby to compensate the weight of the internal components.

According to another manufacturing technique, each part of the body is hollow and formed by an assembly of two injection molded elements corresponding to the exterior and interior shapes of this latter. In this case, the parts forming the body may be filled with synthetic foam to increase their mechanical strength.

According to a preferred and especially economical manufacturing technique, the two pieces of the body are extrusion blown from polyethylene.

Especially light and strong embodiments are constructed as a composite with a core of synthetic foam.

Figure 9:
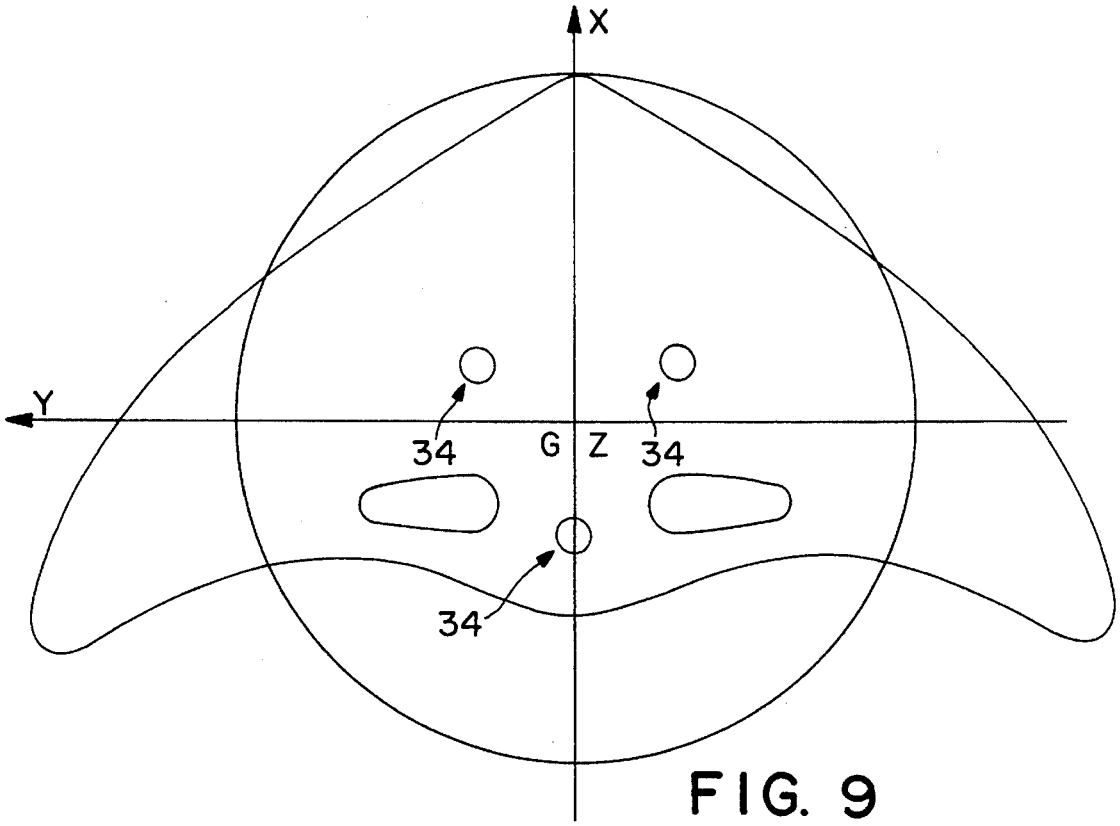
FIG. 9 shows a plan view of the present invention depicting a perfectly balanced propulsion device according to the invention.

For all of these cases, FIG. 9 shows an optimum technique for perfectly equilibrating the propulsion device, using three additional weights 34 which are adjustable and situated at 120° intervals about a circle centered on the center of hydrostatic buoyancy.

The propulsion device according to the invention is intended for use by divers equipped with tanks of compressed air, as well as surface divers.

This propulsion device may also serve for beach games, underwater ballets, and as stand-by devices for oil drillers, for example.

Its manufacture is simplified to the maximum extent, and its performance and appearance are exceptional.

I claim:

1. Electric propulsion device for underwater diving, comprising a body extending in the direction of a longitudinal axis from a forward end to a rearward end, said body including a hydrodynamic propulsion system for propelling said device underwater, said body lying in a displacement plane and having an inlet opening at said forward end defining a first fluid flow path, and two divergent fluid flow paths each of which extends from said first fluid flow path to said rearward end at respective lateral positions in relation to said longitudinal axis in said displacement plane, such that in use, a diver extends in the direction of said longitudinal axis in said displacement plane, and each divergent fluid flow path flows in the direction of said longitudinal axis on either side of said diver, and in said displacement plane.

2. Electric propulsion device according to claim 1, wherein the body is obtained by assembling two symmetrical parts.

3. Electric propulsion device according to claim 2, wherein the two symmetrical parts constituting the body form by their assembly two transferences diverging from the inlet opening, said transferences joining to form a separation edge for the first fluid flow path, a cavity for a propeller, and a water inlet.

4. Electric propulsion device according to claim 3, wherein fluid flow in the transferences is effected along a dynamic axis generated by the progressive inversion of an asymmetric conduit profile along their axis of geometric symmetry.

5. Electric propulsion device according to claim 3, wherein the body has on its rearward end two cavities forming integral handles.

6. Electric propulsion device according to claim 2, wherein the two symmetrical parts constituting the body form by their assembly a cavity for a motor and an electronic piloting system near the center of hydrostatic buoyancy.

7. Electric propulsion device according to claim 2, further comprising foam elements for adjusting the relative density of the body, said foam elements having a density which is less than one, and being shaped to correspond to hollow cavities disposed in the two symmetrical parts.

8. Electric propulsion device according to claim 2, further comprising two flaps positioned at the ends of the symmetrical parts and controlled by a system of shafts and levers from integral handles, along an axis of rotation within the assembly plane and perpendicular to the longitudinal axis.

9. Electric propulsion device according to claim 2, further comprising two nozzles positioned at the ends of the symmetrical parts and controlled by a system of shafts and levers from integral handles, along an axis of rotation within the assembly plane and perpendicular to the longitudinal axis.

10. Electric propulsion device according to claim 1, further comprising additional weights in housings situated about the center of hydrostatic buoyancy for adjusting the position of the center of gravity with respect to the center of hydrostatic buoyancy.

11. Electric propulsion device according to claim 1, wherein the rearward end receives a power supply cable, and has an arrangement for receiving a battery pack.

12. Electric propulsion device according to claim 1, wherein the first fluid flow path extends in the displacement plane.

* * * * *